United States Patent [19]

Rohrbach

[11] 4,348,961

[45] Sep. 14, 1982

[54] FAIL-SAFE CONTROL DEVICE FOR DRIVERLESS VEHICLES

[75] Inventor: Peter H. Rohrbach, Bethlehem, Pa.

[73] Assignee: SI Handling Systems, Inc., Easton, Pa.

[21] Appl. No.: 166,511

[22] Filed: Jul. 7, 1980

[51] Int. Cl.[3] ..... B61K 7/02

[52] U.S. Cl. ..... 104/252; 74/567; 104/166; 104/249; 198/343

[58] Field of Search ..... 104/165, 166, 249, 252; 246/203 R, 203 C, 204, 206; 198/343, 633; 74/567, 569

[56] References Cited

U.S. PATENT DOCUMENTS

| | | | |
|---|---|---|---|
| 488,892 | 12/1892 | Hassall | 246/203 R X |
| 3,216,547 | 11/1965 | DeGood et al. | 198/633 X |
| 3,503,471 | 3/1970 | Balke | 104/249 X |
| 3,897,735 | 8/1975 | Watts | 104/166 |
| 3,903,810 | 9/1975 | Jones | 104/166 |
| 4,086,854 | 5/1978 | Scheel | 104/166 |

*Primary Examiner*—Randolph A. Reese

*Attorney, Agent, or Firm*—Seidel, Gonda, Goldhammer & Panitch

[57] ABSTRACT

A control device for controlling the speed of driverless vehicles moving along a track is selectively operable for stopping vehicles by contact therewith. The device is operated by a motor. Springs are provided for biasing the device to an operative position for contact with the vehicle upon failure of supply of power to the motor.

9 Claims, 4 Drawing Figures

FAIL-SAFE CONTROL DEVICE FOR DRIVERLESS VEHICLES

BACKGROUND

The device of the present invention is an improvement over that disclosed in U.S. Pat. No. 3,903,810. The device in said patent operates satisfactorily for the purposes disclosed therein. I have analyzed the device disclosed in said patent and have made various improvements. If there is a power failure, the device disclosed in said patent will permit all vehicles to bypass the control device since the device may be in an inoperative position. This is an undesirable feature and is solved by the present invention wherein the control device is in an operative position for stopping all vehicles in the event of an power failure while at the same time having other advantages over the device disclosed in said patent.

SUMMARY OF THE INVENTION

The control device of the present invention is adapted for controlling the speed of vehicles in a conveyor system wherein the vehicles move along a track. A cam having a cam surface is provided for contact with a cam follower on a vehicle moving along the track. The cam surface is mounted for movement between operative and inoperative positions. A motor means is provided for selectively retaining said cam surface in an operative position. A means is provided for moving the cam surface to an operative position upon failure of supply of power to said motor.

It is an object of the present invention to provide a control device for driverless vehicles which is fail-safe in that all vehicles will be stopped in the event of failure of supply of power to a motor associated with the device.

It is another object of the present invention to provide a vehicle control device which relies on the weight of the vehicle to maintain a cam horizontal after release of a vehicle and while the vehicle is accelerating.

Other objects will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
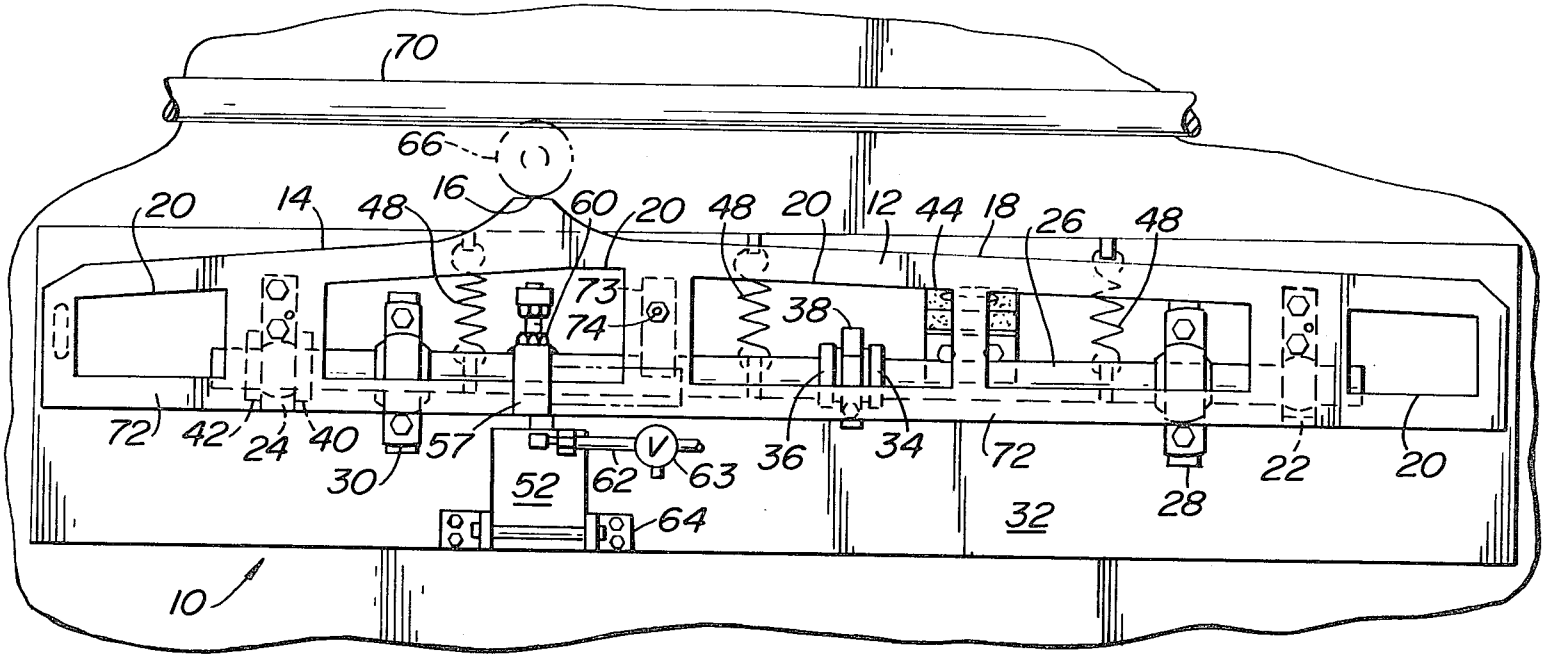
FIG. 1 is a top plan view of a device in accordance with the present invention.

Referring to the drawings in detail, wherein like numerals indicate like elements, there is shown in FIG. 1 a fail-safe control device in accordance with the present invention designated generally as 10. The device 10 includes a cam 12 in the form of a horizontally disposed flat plate. Along one edge of the cam 12, there is provided an acceleration surface 14, merging into a dwell surface 16, which merges into a deceleration surface 18. To decrease the weight of the cam 12, it is provided with a plurality of cut-out openings 20.

Bearing members 22, 24 are attached to the bottom surface of cam 12. The members 22, 24 are rotatably supported by a horizontally disposed shaft 26. The shaft 26 is provided with bearing supports 28, 30 attached to the top surface of a baseplate 32. Collars 34, 36 are provided on the shaft 26 on opposite sides of a fixed post 38. Post 38 is secured to the baseplate 32 and cooperates with the collars 34, 36 to prevent shifting of the shaft 26 in a longitudinal direction. Collars 40, 42 are provided on the shaft 26 on opposite sides of the bearing member 24 to prevent the cam 12 from shifting in a longitudinal direction along the shaft 26.

Figure 3:
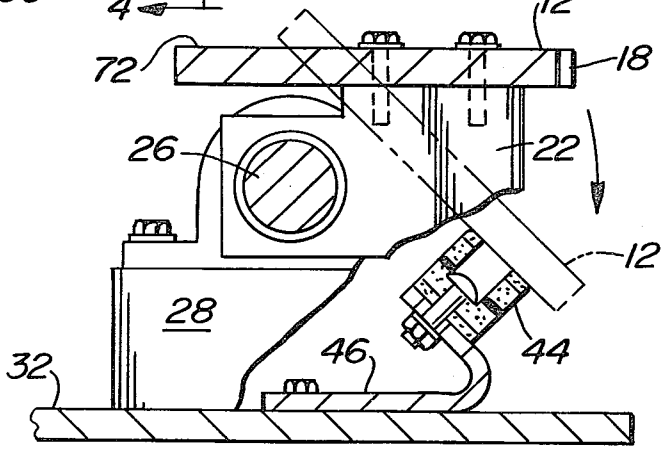
FIG. 3 is a sectional view taken along the line 3—3 in FIG. 2 but on an enlarged scale.

In an operative position, the cam 12 is horizontally disposed and parallel to the baseplate 32. In an inoperative position, the cam 12 assumes the phantom position shown in each of FIGS. 3 and 4. In the inoperative position, the cam 12 engages a limit stop bumper 44. Bumper 44 is adjustably connected to the base plate 32 by way of a bracket 46.

Figure 4:
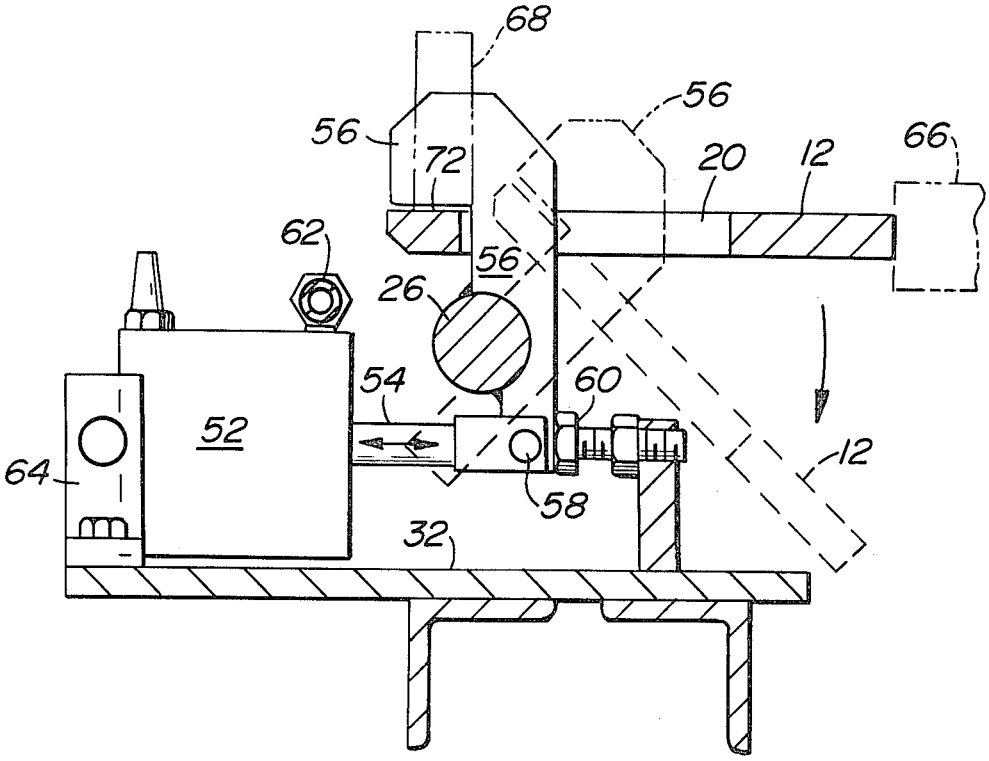
FIG. 4 is a sectional view taken along the line 4—4 in FIG. 2 but on an enlarged scale.

A plurality of springs 48 have one end connected to the shaft 26. The other end of each spring 48 is connected to the baseplate 32. Springs 48 are preferably coil springs which bias the shaft 26 to a rotative position as shown in FIG. 4. As will be made clear hereinafter, the springs 48 render the device 10 "fail-safe". That is, the cam 12 will be returned to an operative position in the event of failure of electrical power supply or air supply.

A motor means 52 is provided. Motor means 52 is preferably a pneumatic motor. If desired, motor 52 could be a solenoid motor or hydraulic motor. As illustrated, motor 52 is a pneumatic motor and contains a piston connected to the piston rod 54. The piston rod 54 is pivotably connected to one end of a lever 56 by way of a pin 58. An adjustable limit stop 60 is provided on the baseplate 32 to limit one end of the stroke of the piston rod 54. The lever 56 intermediate its ends is fixedly secured to the shaft 26 and projects through a hole 20 in the cam 12. Lever 56 preferably has an extension which overlies the top surface of cam 12.

A single conduit 62 is provided for supplying motive fluid to the motor 52 for moving the lever 56 from the solid line position to the phantom position shown in FIG. 4. Motor fluid supplied by conduit 62 is controlled by solenoid valve 63 and is directed to one face of the piston. The other face of the piston is vented to atmosphere. The motor 52 is adjustably attached to the baseplate 32 by way of brackets 64.

Figure 2:
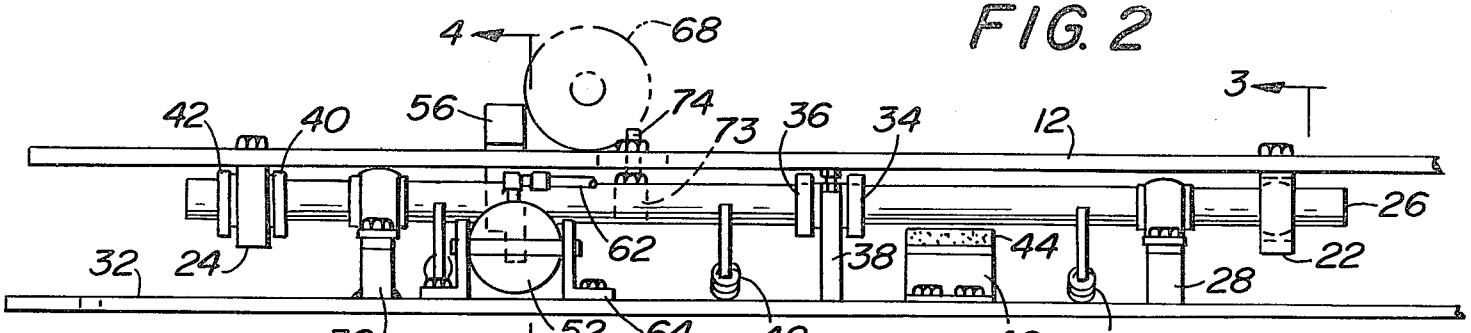
FIG. 2 is a side elevation view of the device shown in FIG. 1.

A cam follower 66 on a driverless vehicle (not shown) is adapted to contact the surfaces 14, 16 and 18 on the cam 12. Cam follower 66 may be a conventional cam follower as opposed to the specially configured cam follower in U.S. Pat. No. 3,903,810. Cam follower 66 is adapted to pivot the drive wheel in contact with the drive shaft 70. Pivotable movement of the drive wheel causes the vehicle to accelerate or decelerate. When the cam follower 66 is in contact with the dwell surface 16, there is virtually no forward driving force on the vehicle. While cam follower 66 is in contact with one of the surfaces 14, 16 and 18, a roller 68 on the vehicle is in rolling contact with the top surface of cam 12 and is aligned with the projection 57 on the lever 56. Projection 57 acts as a limit stop for the roller 68 as shown more clearly in FIG. 2.

A lever 73 is fixedly secured to shaft 26 and projects horizontally. See FIGS. 1 and 2. A bolt 74 is threaded to cam 12 and depends downwardly therefrom so that its head may contact the top surface of lever 73. When bolt 74 is properly adjusted and lever 73 is horizontal, cam 12 is horizontal.

OPERATION

It is assumed that the plate 12 is in the solid line position shown in the drawings. It is also assumed that it is desired to cause a vehicle to accumulate at the location of device 10. Device 10 is located between tracks on which the vehicle rides. Let it be assumed that the vehicle is moving from right to left in FIG. 1. As the cam follower 66 contacts the surface 18, the vehicle decelerates. Roller 68 on the vehicle rides on top of the cam 12 along the flat straight area designated 72 and located on the opposite side of the axis of shaft 26 from the surfaces 14, 16, 18. When the cam follower 66 reaches the dwell surface 16, the roller 68 contacts the projection on the lever 56. See FIG. 2. At this point, the vehicle remains stationary since the cam follower 66 will have pivoted the drive wheel on the vehicle to an accumulation or stop position.

When it is desired to permit the vehicle to continue along the tracks, solenoid valve 63 in conduit 62 moves to an open position so that pneumatic pressure may be introduced into the motor 52. The pneumatic pressure pivots the lever 56 from the solid line position to the phantom position as shown in FIG. 4. The roller 68 is no longer blocked by the projection 57 whereby the vehicle may creep at a slow rate until the cam follower 66 engages the acceleration surface 14. Cam 12 remains horizontally disposed since the weight of the vehicle is transmittted thereto by way of the roller 68. After the vehicle has passed the cam 12, and roller 68 is no longer riding on the top surface of the cam 12, the cam 12 pivots about the axis of shaft 26 to the phantom position shown in FIGS. 3 and 4. The springs 48 and 50 are stretched and try to pivot the shaft 26. Such pivotable movement is opposed by the pneumatic pressure on the piston within motor 52. Subsequent vehicles will be permitted to pass the device 10 without stopping.

When it is desired to cause another vehicle to stop at device 10, pneumatic pressure supplied by way of conduit 62 is terminated by closing valve 63 and the associated surface of the piston is vented to atmosphere by way of the solenoid valve 63. Springs 48 and 50 contract and rotate the shaft 26 and lever 56 from the phantom position in FIG. 4 to the solid line position in FIG. 4. As the lever 56 pivots to the solid line position, lever 73 contacts bolt 74 and pivots the cam 12 from the phantom position to the solid line position in FIG. 4. The next vehicle will be accumulated or stopped in the manner described above.

It is desired to have the device 10 "fail-safe". When the cam 12 is in the phantom position, vehicles will bypass the device 10. If there is an electrical or pneumatic power failure while cam 12 is in the phantom position shown in FIGS. 3 and 4, all subsequent vehicles will normally bypass the device 10. In the event of such power failure, the springs 48, 50 will return the plate 12 to the solid line position as described above so that all subsequent vehicles will be caused to accumulate or stop at the device 10 until there is a resumption of power supply and/or the vehicles are manually released.

The roller 68 performs a dual function as described above. That is, roller 68 contacts the lever 56 which acts as a limit stop when lever 56 is in its solid line position in FIG. 4. Also, the weight of the vehicle is transmitted by way of roller 68 to the top surface of the cam 12 to prevent the cam 12 from pivoting until after the vehicle has traversed the device 10. The signal for controlling the solenoid operated valve 63 in the conduit 62 may be triggered automatically, by way of a footpedal or may be accomplished manually. Thus, the device 10 is more reliable and versatile while being fail-safe in comparison with the prior art.

The present invention may be embodied in other specific forms without departing from the spirit or essential attributes thereof and, accordingly, reference should be made to the appended claims, rather than to the foregoing specification, as indicating the scope of the invention.

I claim:

1. A control device for controlling the speed of a vehicle in a conveyor system of vehicles which move along a track comprising a cam having a cam surface for contact with a cam follower on a vehicle, means mounting said cam surface for movement between operative and inoperative positions, said cam having converging cam surfaces along one side edge, said cam having a flat straight surface area for contact with a roller on a vehicle whose speed is controlled by said cam surfaces, said mounting means including horizontally disposed shaft below the elevation of said cam, said area being on one side of the axis of said shaft and said cam surfaces being on the other side of said axis, a motor coupled to said cam for selectively retaining said cam in an operative position, and means for automatically moving said cam surface to an operative position from an inoperative position upon failure of supply of power to said motor.

2. A device in accordance with claim 1 wherein said last-mentioned means includes at least one spring biasing said cam to its operative position.

3. A device in accordance with claim 1 wherein said motor is coupled to said cam by way of a lever having a projection above the surface of the cam in the operative position of the cam for performing the function of a limit stop.

4. A device in accordance with claim 3 wherein said cam has an opening through which said lever projects.

5. A control device for controlling the speed of driverless vehicles which move along a track comprising a horizontally disposed shaft supported for oscillation about its axis, a horizontally disposed cam pivotably supported by said shaft at an elevation above the elevation of the shaft, one side edge of said cam having surfaces converging to a dwell, an opposite side edge portion of said cam having means for rolling contact, said means for rolling contact including a flat straight horizontal surface area for contact with a roller on a vehicle whose speed is controlled by said surfaces, a motor means operatively arranged for permitting the cam to pivot about said shaft axis from an operative position to an inoperative position in the absence of contact between the cam and a roller on a vehicle, and spring means for moving said cam surface to an operative position upon failure of supply of power to said motor means.

6. A device in accordance with claim 5 wherein said spring means is connected at one end to a stationary support and connected at the opposite end to said shaft.

7. A device in accordance with claim 6 including a lever secured to said shaft for oscillation therewith, one end portion of said lever being pivotably connected to said motor, the other end portion of said lever being arranged to contact the cam and pivot the cam about the axis of said shaft as said shaft oscillates due to the bias of the spring means.

8. A device in accordance with claim 7 wherein said other end portion of said lever extends through a hole in said cam and projects thereabove with a projection thereon overlying the top surface of said cam, said projection being a limit stop for contact with a portion of a vehicle.

9. A control device for controlling the speed of a vehicle in a conveyor system of vehicles which move along a track comprising a cam having a cam surface for contact with a cam follower on a vehicle, means mounting said cam surface for movement between operative and inoperative positions, a motor coupled to said cam for selectively retaining said cam in an operative position, said cam being pivotably supported by a shaft, a lever arm fixedly secured to said shaft, one end portion of said lever arm being pivotably connected to said motor, the other end portion of said lever retaining said cam in an operative position, said cam being gravity biased to an inoperative position and restrained by said other end portion of said lever, and means for automatically moving said cam surface to an operative position from an inoperative position upon failure of supply of power to said motor.

* * * * *